US007721567B2

(12) United States Patent
Dalton et al.

(10) Patent No.: US 7,721,567 B2
(45) Date of Patent: May 25, 2010

(54) COOLING, CARBONATION AND DISPENSING SYSTEM FOR A LIQUID IN A KEG

(76) Inventors: Jeffrey Travis Dalton, 1187 Pittsfield La., Ventura, CA (US) 93001; Michael Klatzo, 671 Poaug La., Mt. Pleasant, SC (US) 29646; Michael Lee Kjer, Room 1015, 10/F, Tower A, Hung Hom Commercial Centre, 39 Ma Tau Wai Road, Hung Hom, Kowloon, Hong Kong (CN); Andrew Jin, Room 1015, 10/F, Tower A, Hung Hom Commercial Centre, 39 Ma Tau Wai Road, Hung Hom, Kowloon, Hong Kong (CN)

( * ) Notice: Subject to any disclaimer, the term of this patent is extended or adjusted under 35 U.S.C. 154(b) by 136 days.

(21) Appl. No.: 11/840,458

(22) Filed: Aug. 17, 2007

(65) Prior Publication Data

US 2009/0044561 A1 Feb. 19, 2009

(51) Int. Cl.
*B67D 5/62* (2006.01)

(52) U.S. Cl. ..... 62/389; 222/146.6

(58) Field of Classification Search ..... 62/389, 62/386, 399, 457.4; 222/146.6, 399, 400.7
See application file for complete search history.

(56) References Cited

U.S. PATENT DOCUMENTS 2,575,906 A * 11/1951 Bullard ..... 137/528
4,350,267 A * 9/1982 Nelson et al. ..... 222/131
5,564,568 A * 10/1996 Rankin, Sr. ..... 206/446
5,956,966 A * 9/1999 Wendell ..... 62/389
6,105,825 A * 8/2000 Gomi et al. ..... 222/146.6
2007/0051125 A1* 3/2007 Chiusolo et al. ..... 62/393

* cited by examiner

*Primary Examiner*—William E. Tapolcai
*Assistant Examiner*—Lakiya Rogers
(74) *Attorney, Agent, or Firm*—Richard S. Erbe

(57) ABSTRACT

A cooling, carbonation and dispensing system for use with a liquid in a keg includes a cooling ring mounted on top of the keg. The cooling ring includes a toroidal-shaped shell into which dry ice is placed. The cooling ring and dry ice provide contact cooling of the keg, as well as carbon dioxide gas by sublimation of the dry ice to carbonate the liquid in the keg and pressure on the liquid so that it may be dispensed from the keg. A chilling unit having a hose bundle is mounted on top of the cooling ring. A liquid dispensing hose from the keg coupler on the keg connects to the hose bundle, so that liquid from the keg passes through the hose bundle. A lid having a tower is attached to the top of the chilling unit and latched to it to form a water-tight seal. Another hose connects to the hose bundle in the chilling unit and conducts the liquid to a dispensing hose attached to a dispenser in the tower. Wet ice is placed in the chilling unit and the tower to provide further chilling (flash chilling) of the liquid. The components of the assembled system may be wrapped in an insulating blanket to provide further cooling.

6 Claims, 8 Drawing Sheets

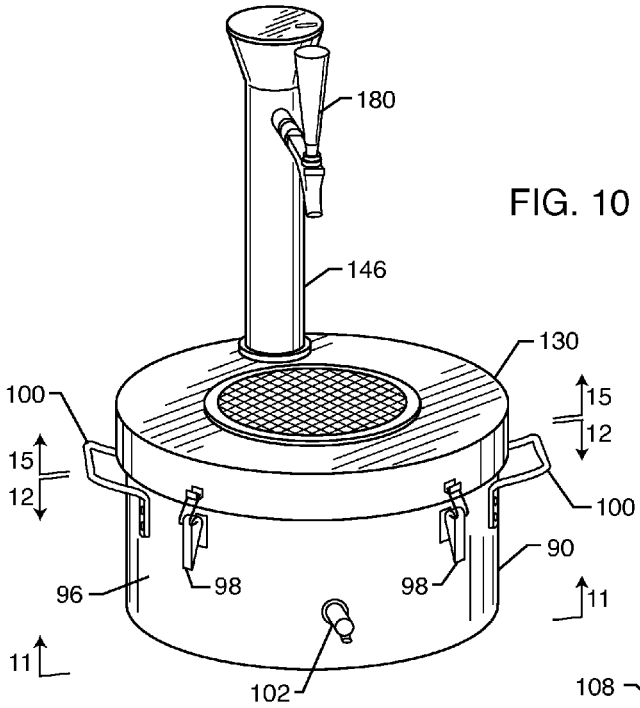
FIG. 10
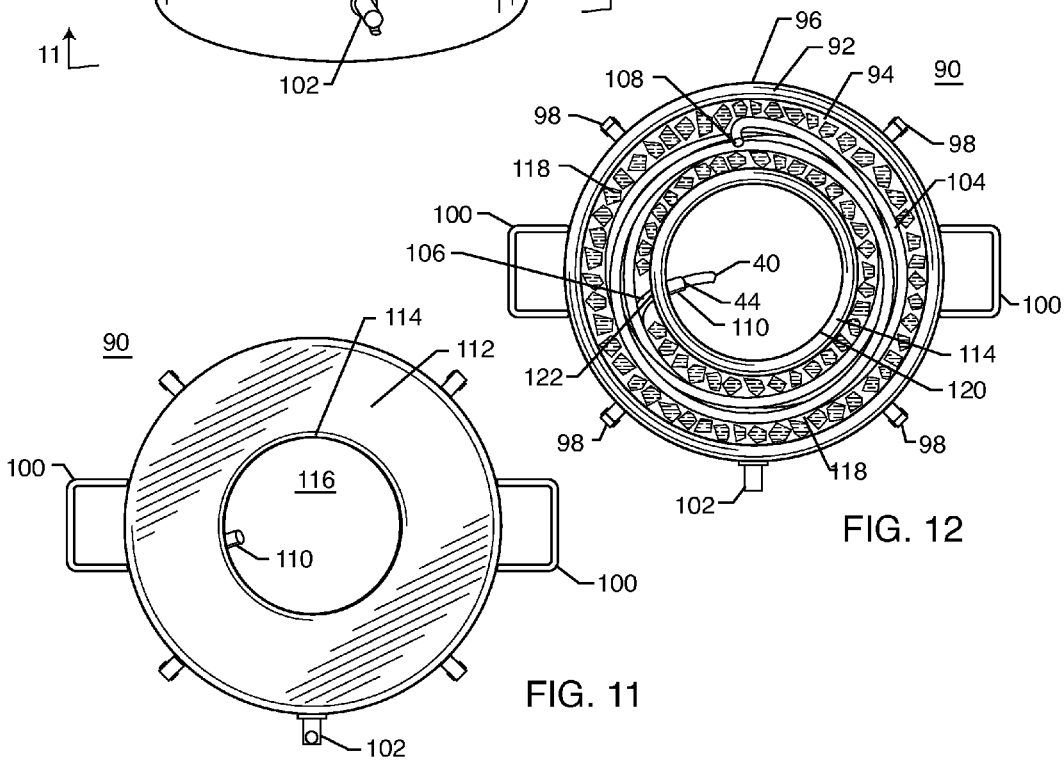
FIG. 12
FIG. 11

COOLING, CARBONATION AND DISPENSING SYSTEM FOR A LIQUID IN A KEG

RELATED APPLICATIONS

Not applicable.

BACKGROUND OF THE INVENTION

1. Field of the Invention

The present invention relates to the field of cooling, carbonation and dispensing systems. More specifically, the invention relates to a system used for maintaining temperature and carbonation of a liquid, such as beer, and dispensing that liquid from a keg. Although much of the following discussion is directed towards beer as the liquid, those skilled in the art will understand that such a system as that described herein could be used in conjunction with any liquid that is stored inside a keg (pressurized liquid holding vessel).

2. General Background and State of the Art

Beer brewers and beer drinkers generally know that in order to have the best tasting beer as crafted by a brewmaster, they would drink the beer at the brewery directly from the fermenting or lagering (aging) tank. Because beer is extremely sensitive to heat and oxygen, most bottled or canned beer, in order to have a reasonable shelf life, is pasteurized (rapidly heated, then cooled). The pasteurization process inhibits the flavor dynamic and changes the composition of the beer.

Draught beer (keg beer) produced in North America is almost always unpasteurized and retains more fresh beer flavor than beer from bottles or cans. The taste of the beer from the keg, if the keg is handled and maintained properly, can approximate the taste of the beer that can be obtained at the brewery, fresh from the lagering tank.

U.S. domestic draught beer (keg beer) is almost always unpasteurized and retains more fresh beer flavor than beer from bottles or cans. The taste of the beer from the keg, if the keg is handled and maintained properly, can approximate the taste of the beer that can be obtained directly from the lagering tanks at the brewery. In beer markets outside of North America, lack of consistent and effective refrigeration throughout the brewer-to-consumer supply chains, necessitates that the brewer pasteurize draught beer in order to prevent spoilage (for unpasteurized draught beer, spoilage begins at temperatures greater than 45° F.).

Two of the primary factors that affect the composition and taste of draught beer are temperature and carbon dioxide ($CO_2$) gas. The ideal values of these two factors vary between different types and brands of beer, and the balance between these two factors is vitally important in maintaining the best possible taste in draught beer. Temperature affects the taste of draught beer (both unpasteurized and pasteurized), the ability to dispense the draught beer, and the useful life of the beer in the keg. If draught beer is not pasteurized, it must always be kept cold (below 42 and 44° F.) or it will spoil. Ideally, draught beer should be maintained at a constant temperature of approximately 36-38 F as to provide flavorful beer for up to fifty days. Additionally, both unpasteurized and pasteurized draught beer will not dispense in a consumable manner, when passing through a draught beer dispensing system and out a beer faucet into a beer-clean glass, at temperatures greater than 45 F.

$CO_2$ is created naturally during the fermenting process of beer. Further along in the brewing process, additional $CO_2$ is infused into the beer by the brewer. Carbon dioxide is nonflammable, non-toxic, colorless, odorless, and exists in three different states: gas, liquid, or solid. As a gas, $CO_2$ is 1.5 times heavier than air. $CO_2$, in its solid form, is commonly called "dry ice." $CO_2$, in liquid or gaseous form, is water soluble and dissolves easily in beer. The amount of the gas dissolved into a particular beer is measured in $CO_2$ volumes. For example, if one liter of beer is carbonated to 2.5 volumes, there are 2.5 liters of $CO_2$ dissolved into the beer. $CO_2$ gas is odorless with no detectable flavor, but as it expands out of the beer (bubbles and foams), it does release aromas and flavor characteristics of the beer, affecting the flavor. When a brewer produces a beer, he takes diligent care to control the carbonation level ($CO_2$ content) in a way to bring out the preferred flavors and aromas, as to affect the flavor in a controlled way.

Pressurized $CO_2$ serves a number of functions for kegged beer. $CO_2$ is pumped into the keg to maintain the proper level of balance of $CO_2$ in the beer and it also serves to prevent air (which contains oxygen that promotes bacteria growth) from contacting the beer, which can spoil the composition and taste of the beer. $CO_2$ is also utilized as a pressure source to force the beer out of the keg while maintaining the proper carbonation volume levels of the beer. Currently, outside of Europe and North America, the quality of $CO_2$ gas used for dispensing beer is not always of Food or Beverage Grade. Quality of $CO_2$ gas is region dependant.

Pressure, maintained in pounds per square inch gauge, is defined as the force at which the gaseous $CO_2$ enters the head-space of a keg, pushing on the beer. As the pressure increases, the gas molecules hit the beer with more force and dissolve into the beer more easily. As the pressure decreases, the gas molecules do not dissolve in the beer as easily and $CO_2$ gas can escape from the beer. Excess pressure increases the carbonation level, while inadequate pressure decreases the carbonation level. The right amount of pressure applied to beer inside a keg is needed to maintain the proper or optimal carbonation level of the beer as well as to push the beer through the dispensing system.

The temperature of the beer affects the amount of pressure needed in the keg to control the optimal carbonation level. As the temperature of the beer increases, $CO_2$ expands and the gas bubbles will come out of the beer. As the temperature of the beer decreases, $CO_2$ dissolves more easily into the beer. Generally, a two-degree Fahrenheit increase in beer temperature requires a one pound increase in pressure to maintain optimal carbonation equilibrium, while a two-degree Fahrenheit decrease in beer temperature requires a one pound decrease in pressure to maintain optimal carbonation equilibrium as per the brewer-designed carbonation levels.

It is vitally important to keep the carbonation level of draft beer at the proper (or optimal) brewer-designed carbonation levels. Too little carbonation (low pressure) leads to flat beer. Too high of a carbonation level (high pressure) leads to off-taste problems as well as foaming/dispensing issues.

Typically, a keg of beer served at a private party is stored in a large bucket filled with water and wet ice (as opposed to dry ice) and is dispensed by using pressurized air via a hand-operated pump. Since the beer, in this example, is generally consumed over a relatively short period of time (less than 24 hours), the intent at such an event is to keep the beer cold and to keep sufficient pressure applied to the beer keg so that it may be dispensed. Adding air to draught beer, however, causes the beer to go off-taste due to oxidation, limiting optimal flavor for the duration of the keg. For that reason, often times a high-pressure carbon dioxide supply ($CO_2$ cylinder or $CO_2$ bottle) provides the pressure, via a pressure regulator attached to the carbon dioxide supply, to force the beer out of the keg.

A number of problems are associated with dispensing beer or other kegged liquids in the manner just described. First, there is the presence of a gas trapped under high-pressure in a pressurized container. If the container somehow becomes damaged and the highly-pressurized carbon dioxide gas leaks, there is the potential for injury. Also, the beer or other liquid in the keg will likely spoil because of inadequate pressure. There exists the likelihood that the user may not install and maintain the carbon dioxide system properly, which can quickly make the beer lose its flavor and to make dispensing the beer difficult. Once the pressurized container of gas is empty, it must be immediately refilled from a highly-pressurized liquid $CO_2$ source, or replaced by another pre-filled highly-pressurized vessel. There is also a quality issue in that refilling a small highly-pressurized vessel over time allows for the possibility of air, moisture, dirt, insects or other contaminants to collect on the fittings and/or in the vessel ($CO_2$ cylinder) thereby introducing contaminants into the beer and causing the beer to go off-taste.

Some contaminants, in the form of microorganisms, are not easily cleansed and removed from hoses and from inside the vessel. These microorganisms may cause disease or illness to consumers. One major beverage distributor, Anheuser-Busch, requires U.S.-located users of its products to install a $CO_2$ filter between the $CO_2$ cylinder and the keg to filter out dirt and microorganisms before the $CO_2$ stored in the $CO_2$ cylinder reaches the keg.

In addition, there is the added cost associated with requiring the highly-pressurized container to meet Department of Transportation (DOT) standards. Therefore, DOT high-pressure vessel transportation regulations and restrictions apply to these pressurized vessels ($CO_2$ cylinders) as well.

Another problem associated with dispensing beer in the example just described is that the wet ice bath in which the keg is placed may, depending on the surrounding conditions, melt quickly and reduce the ability to keep the beer cold. This can be especially problematic on hot days. The host or vendor must keep a large supply of wet ice on hand and be alert to replenish the supply of wet ice in the bath and deal with the accumulation of additional water from melting wet ice over time. In some situations, the host or vendor will be inconvenienced by having to make a trip to a store to purchase more wet ice. This difficult situation can be multiplied several times over when liquid from numerous kegs is being dispensed at once, which occurs during outdoor festivals or gatherings.

There thus exists a need for a system for maintaining optimal temperature and proper carbonation as well as dispensing of a liquid, such as beer, that is stored in a keg that does not require the presence of a separate highly-pressurized gas container (commonly called a $CO_2$ cylinder or $CO_2$ bottle) and reduces the need to constantly replenish the supply of wet ice. This system must keep the liquid or beer chilled, optimally carbonated, and under sufficient pressure to dispense the liquid with minimal dispensing issues while maintaining optimal flavor.

SUMMARY OF THE INVENTION

It is therefore an object of the present invention to provide a cooling, carbonation, and dispensing system for a liquid contained in a keg that does not require a highly pressurized vessel ($CO_2$ cylinder) of carbon dioxide gas to pressurize the liquid to enable the liquid to flow out of the keg to be dispensed.

It is another object of the present invention to provide a cooling, carbonation, and dispensing system for a liquid contained in a keg that does not require a highly pressurized vessel ($CO_2$ cylinder) of carbon dioxide gas to keep the liquid optimally carbonated.

It is a further object of the present invention to provide a cooling, carbonation, and dispensing system for a liquid contained in a keg that does not require an excessive quantity of wet ice to maintain the cooling.

Yet another object of the present invention to provide a cooling, carbonation, and dispensing system for a liquid contained in a keg that does not require wet ice for cooling to be frequently replenished.

These and other objectives are achieved by the present invention, which, in a broad aspect, provides a cooling, carbonation, and dispensing system for a liquid contained in a keg that uses carbon dioxide in a solid state (better known as dry ice) to provide optimal $CO_2$ pressurization of the liquid, and to utilize the extremely cold temperature of dry ice to enhance heat transfer during contact cooling of the keg. The system in accordance with the present invention also provides "flash chilling" of the liquid by wet ice as it is dispensed from the keg.

There are several other advantages in using Beverage Grade or Food Grade dry ice to provide cooling, carbonation, and dispensing of liquids over known systems that use pressurized $CO_2$ cylinders. The quality of the $CO_2$ gas used in the system of the present invention is much more easily controlled by the user than in present conventional systems to prevent contamination of the liquid by dirt, insects, and microorganisms from the $CO_2$.

Microorganisms that cause disease and illness in humans may be easily introduced into presently used conventional $CO_2$ systems, and once there, may be difficult to remove or cleanse. Such microorganisms require the presence of light, moisture, oxygen and warm temperatures between 40° F. and 160° F. in order to survive and grow. The cooling ring of the system of the present invention deprives microorganisms of these factors. Microorganisms are deprived of light because the cooling ring is enclosed and shielded from light. When dry ice is added inside the cooling ring and the opening is sealed, the dry ice quickly sublimates into gaseous $CO_2$, pushing any air that was inside the cooling ring out the system's relief vale and creating an oxygen-free area inside. There is no moisture inside, as Beverage Grade dry ice is moisture-free. The temperature of dry ice (−109° F.) inside creates a virtually total "freeze dried" environment. Lastly, the dry ice will physically burn or kill any microorganisms on direct contact and the extreme cold temperatures created will provide an environment that is much to cold for microorganisms to survive or to grow in.

A cooling, carbonation, and dispensing system for a liquid contained in a keg according to a preferred embodiment of the present invention includes several main components that may be mounted on a conventional keg. These components include a cooling ring, a chilling unit, and a lid having a tower. For purposes of the ensuing discussion, the liquid in the keg is beer, and the keg will be one of several standard industry sizes of beer kegs in which beer is stored at a brewery. The keg may be placed on the floor, on a wheeled trolley, or in a tub or bucket. It is not necessary when using the cooling, carbonation, and dispensing system of the present invention to place wet ice around the keg. It is necessary, however, as will be discussed, to put wet ice into the chilling unit and the tower.

The cooling ring comes equipped with a carbon dioxide gas pressure regulator that is connected so that pressurized carbon dioxide gas trapped inside the cooling ring may be provided to carbonate the beer and supply the necessary pressure so that the beer may be dispensed from the keg. Such pressure regulators are readily available and their design and function are well-known to those skilled in the art, so the pressure regulator will not be described in further detail.

A standard keg includes a lip or rail around its top and bottom sides, openings to form hand holds and a keg coupler that allows the keg to be tapped and the beer to be dispensed from out of the keg. A first liquid conducting hose connected to the keg coupler draws beer from the keg due to the pressure exerted by the pressurized carbon dioxide gas applied inside to the keg. The keg coupler also provides a connection for a $CO_2$ gas conducting hose from the pressure regulator to the keg coupler.

A cooling ring is mounted on top of the keg. The cooling ring includes an upper support ring and a lower support ring. Mounted between the two support rings is a generally toroidal-shaped shell that has an opening and a sleeve, which may be sealed by a cap. The lower support ring is configured to fit closely to the lip on the top of the keg. The shell includes an open central space that allows the first liquid conducting hose to be directed through it. The cooling ring also has a plurality of heat sink fins extending from it to the top of the keg to provide additional contact cooling.

The shell also has a connection point for a pressure relief valve and a connecting point for connection to the gas pressure regulator. In use, solid carbon dioxide (commonly known as dry ice) is placed inside the shell through the sleeve and opening. Once the interior of the shell contains a sufficient amount of dry ice, the shell is sealed by placing a cap over the sleeve. Beverage grade dry ice has a temperature of minus 109° F. and is available at a purity level of 99.98% carbon dioxide. Also attached to the shell is a gas pressure relief valve, which helps to relieve gas pressure in the system in the event that the pressure gets too high.

There are several advantages in using dry ice for the system according to the present invention. Dry ice is much colder than conventional wet ice (−109° F. vs. 32° F.) and provides excellent heat transfer and contact cooling of the beer in the keg. The dry ice sublimates from a solid to a gas, providing a source of carbon dioxide gas for carbonating as well as providing optimal pressure for dispensing the beer. In this way, there is no need to use a separate highly pressurized container of carbon dioxide ($CO_2$ cylinder) with all of its attendant potential problems to carbonate and dispense the beer. If there is loss of carbon dioxide pressure below the desired level, instead of having to replace the highly pressurized containers ($CO_2$ cylinder), the user simply opens the sleeve and cap of the shell and inserts more dry ice inside.

The cooling ring in accordance with the system of the present invention also includes a base on which the cooling ring may rest when it is not in use. Not only does the base provide a convenient stand, it also provides protection for the pressure regulator and pressure relief valve against damage when the cooling ring is being moved from location to location or is mounted on a keg.

Mounted on top of the cooling ring is a separate chilling unit that enables the system to "flash chill" the beer as it is dispensed. The chilling unit is of a generally cylindrical shape, with an outer cylinder configured to fit on top of the upper support ring of the cooling ring, a bottom plate, and an inner cylinder. The inner cylinder provides an opening in the bottom plate, through which the first liquid dispensing hose may be directed.

The chilling unit includes a bundle of food grade hose that may be of varying length that mounts between the outer cylinder and the inner cylinder. One end of the hose bundle connects to the first liquid conducting hose, so that beer from the keg will be conducted through the hose bundle. An opening in the inner cylinder provides a means of facilitating the connection between the first liquid conducting hose and the hose bundle. When in use, the chilling unit is filled with wet ice and water, so that further chilling ("flash chilling") of the beer is achieved as beer passes through the hose bundle encased in the wet ice and water bath.

A spigot connected to the outer cylinder may be opened to drain water produced by melting ice from the chilling unit as needed. Also mounted on the outer cylinder are several latches, which connect to a lid, which, when the system is in use, is placed on top of the chilling unit and attached by means of the latches on the chilling unit to locking extensions on the lid.

The lid includes a top plate which has two openings. Attached to the top plate is a flange that fits over the chilling unit. When the lid is attached to the chilling unit by means of the latches, a water-tight seal is formed. A second liquid conducting hose is connected to the other end of the hose bundle in the chilling unit and extends towards one of the openings in the top plate of the lid.

The lid of the system according to the present invention also includes a hollow tower mounted on top of one of the openings in the top plate of the lid. The tower includes a chute and a funnel portion on top of the chute. The tower also includes a hinged cover on top of the funnel portion. An opening in the tower is connected to a beer dispenser (faucet) including a beer dispensing hose, which is directed into and through the tower and connects to the second liquid conducting hose.

The tower may also include insulation in its interior. The tower and lid have an opening to the chilling unit, and wet ice may be placed inside the tower and the chilling unit by lifting or sliding the hinged cover on the tower and placing the ice inside. As wet ice in the chilling unit and the tower melts, it may be drained by means of the spigot on the chilling unit, and fresh wet ice may be placed in the system as previously described.

Thus, in the cooling, carbonation and dispensing system according to the present invention, beer is pushed from the keg through the first liquid conducting hose, then through the hose bundle in the chilling unit, then through the second liquid conducting hose, then through the dispensing hose, and out through the dispenser. Pressure for pushing the beer through the several hoses is provided by the sublimated dry ice captured in the cooling ring.

A cooling and carbonation system according to the present invention also includes an insulating jacket, which physically covers the keg, cooling ring, chilling unit and lid, trapping cool air that enhances and maintains cooling of the keg. Primary cooling of the beer is achieved by contact cooling between the cooling ring and the keg, flash chilling in the chilling unit, and further cooling in the tower.

Further objects and advantages of this invention will become more apparent from the following description of the preferred embodiment, which, taken in conjunction with the accompanying drawings, will illustrate, by way of example, the principles of the invention.

BRIEF DESCRIPTION OF THE DRAWINGS

The foregoing and other aspects and advantages will be better understood from the following detailed description of a preferred embodiment of the invention with reference to the drawings in which:

FIG. 10 illustrates a perspective view of the chilling unit and lid of a preferred embodiment of a cooling, carbonation and dispensing system according to the present invention;

FIG. 11 illustrates a bottom view of the chilling unit of a preferred embodiment of a cooling, carbonation and dispensing system according to the present invention;

FIG. 12 illustrates a top view of a chilling unit of a preferred embodiment of a cooling, carbonation and dispensing system according to the present invention, with the lid removed;

DETAILED DESCRIPTION OF THE PREFERRED EMBODIMENT OF THE INVENTION

In the following description of the invention, reference is made to the accompanying drawings, which form a part thereof, and in which are shown, by way of illustration, an exemplary embodiment illustrating the principles of the cooling and carbonation system of the present invention and how it may be practiced. It is to be understood that other embodiments may be utilized to practice the present invention and structural and functional changes may be made thereto without departing from the scope of the present invention.

Figure 1:
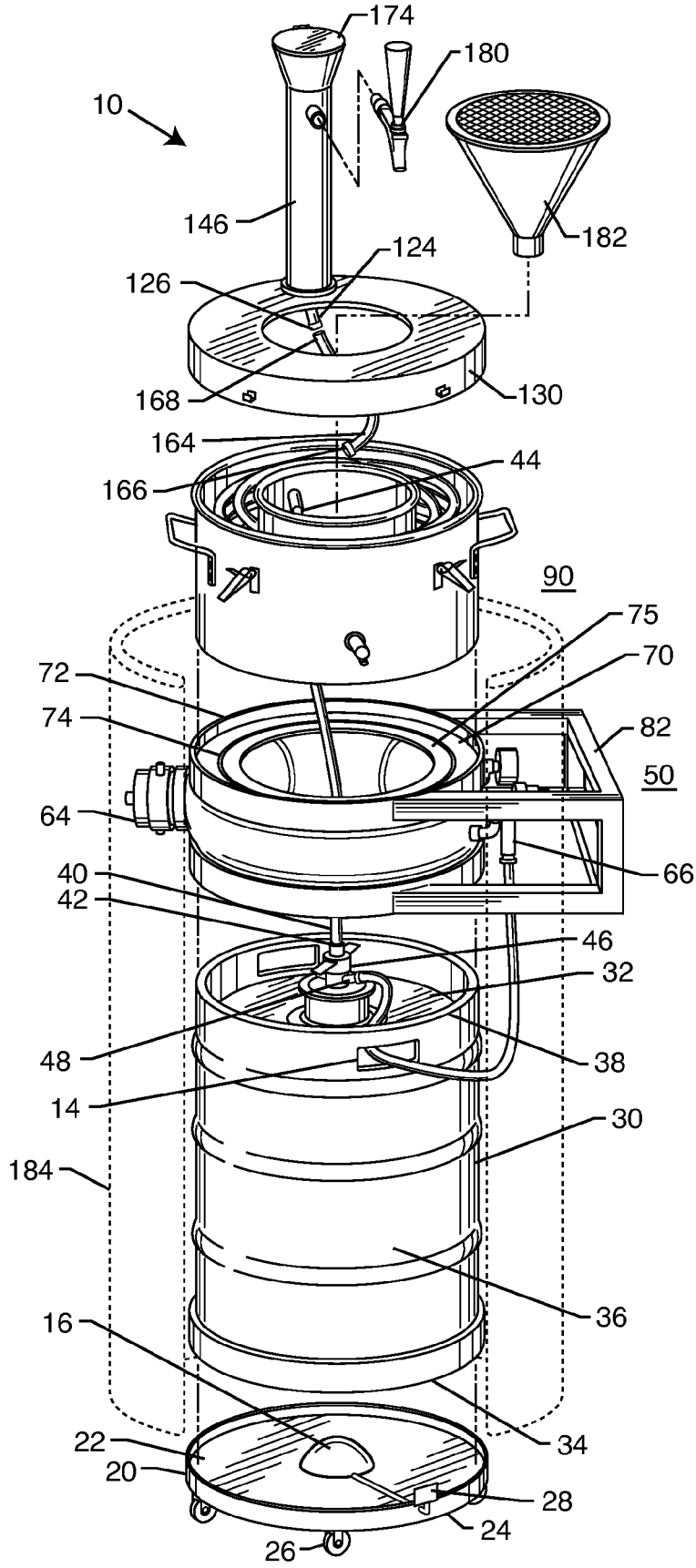
FIG. 1 illustrates an exploded view of a preferred embodiment of a cooling, carbonation and dispensing system according to the present invention.
Figure 2:
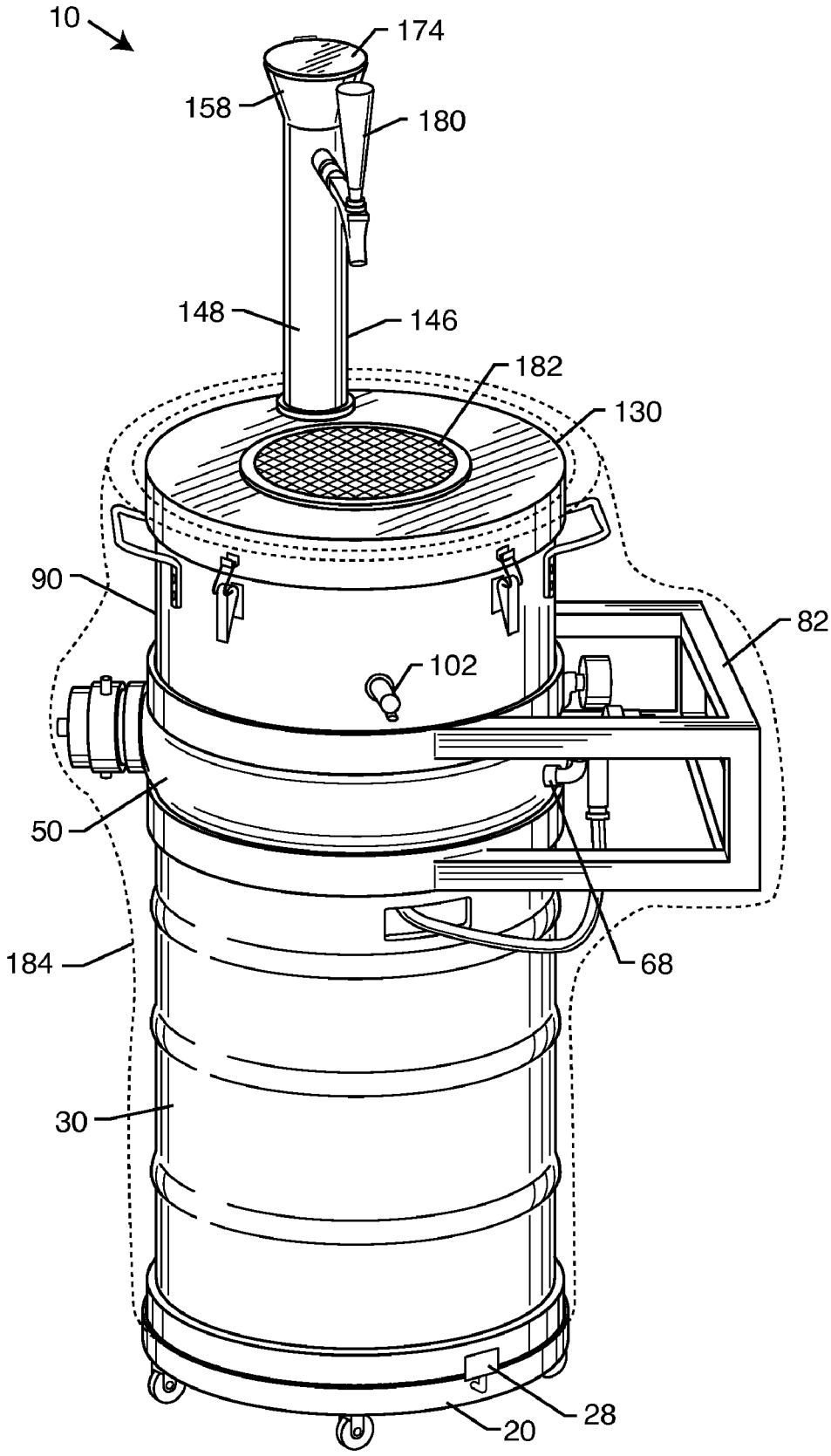
FIG. 2 illustrates a perspective view of a preferred embodiment of a cooling, carbonation and dispensing system according to the present invention, with the insulating jacket shown in dashed lines.
Figure 3:
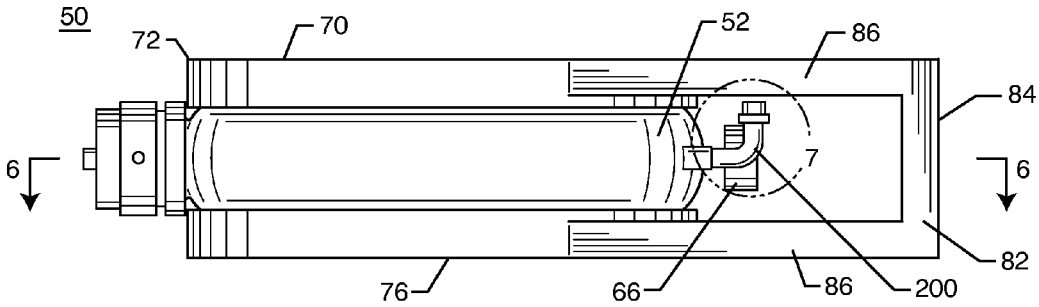
FIG. 3 illustrates a side view of the cooling ring of a preferred embodiment of a cooling, carbonation and dispensing system according to the present invention.
Figure 4:
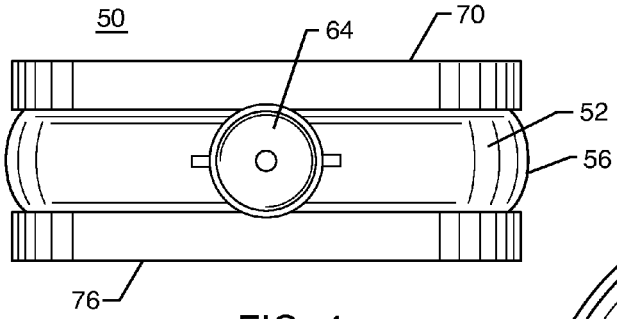
FIG. 4 illustrates another side view of the cooling ring of a preferred embodiment of a cooling, carbonation and dispensing system according to the present invention.
Figure 5:
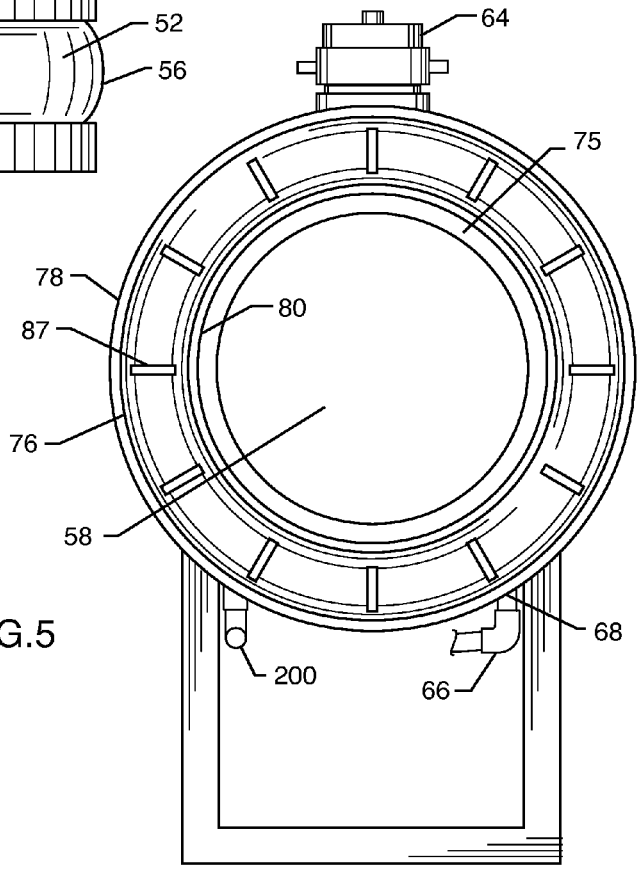
FIG. 5 illustrates a bottom view of the cooling ring of a preferred embodiment of a cooling, carbonation and dispensing system according to the present invention.
Figure 6:
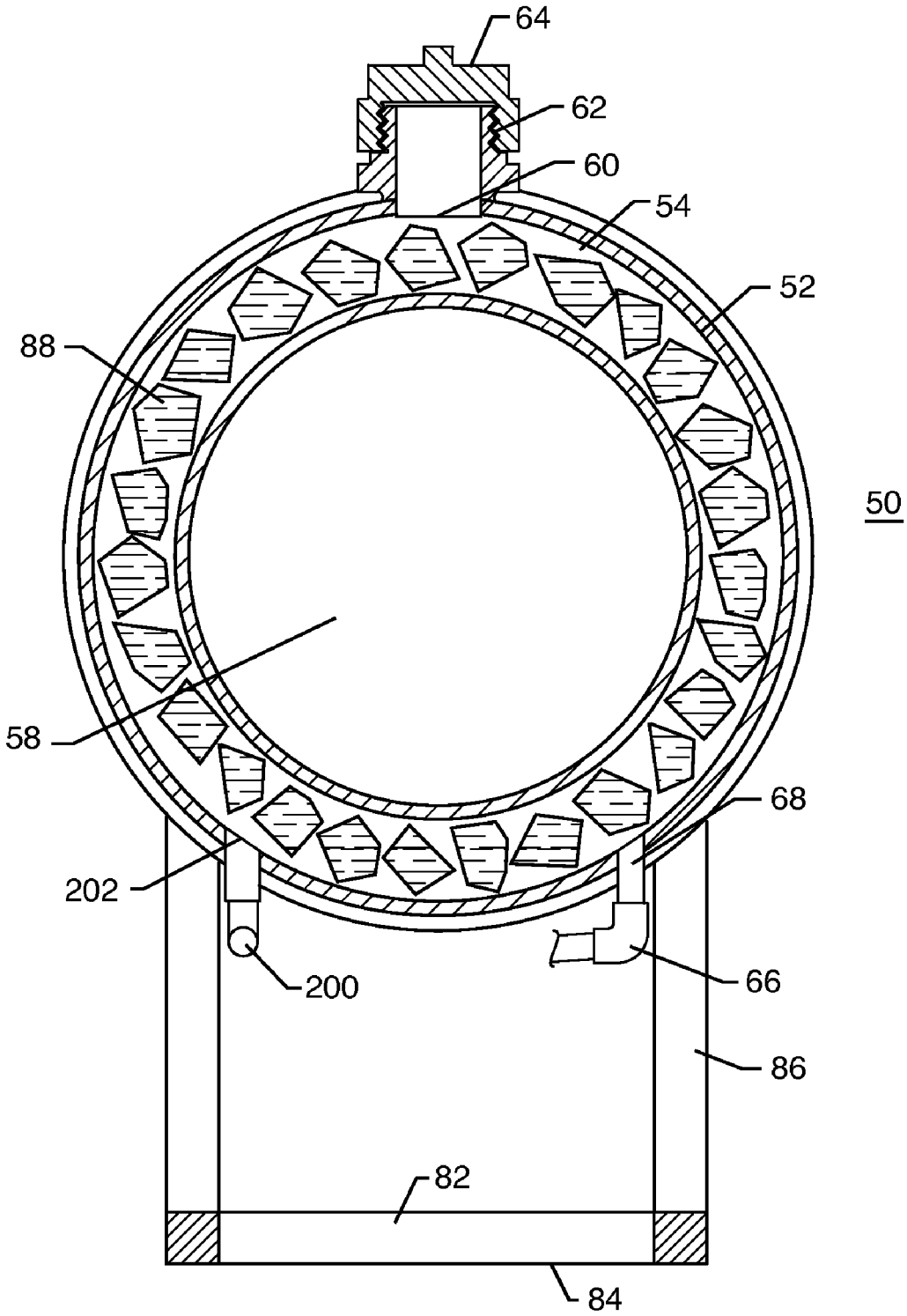
FIG. 6 illustrates a sectional view taken at line 6-6 in FIG. 3.

A cooling, carbonation and dispensing system for a liquid contained in a keg according to a preferred embodiment of the present invention is indicated generally by the numeral 10 and is illustrated in FIGS. 1-2. While not intending the system to be limited to apply to beer as the liquid, the ensuing discussion will use beer as an example of one type of liquid for which the system of the present invention may be used.

The main components of the system, as illustrated in FIGS. 1 and 2, are used in conjunction with a keg 30, which contains the beer. Keg 30 is of a conventional design that is well known for storing carbonated liquids such as beer. Keg 30 includes top 32, bottom 34, outer surface 36, and a lip 38 on top 32 (bottom 34 also includes a lip of similar construction). Keg 30 also includes openings 14 that serve as hand holds. Keg coupler 46 provides an opening through which beer is pushed out of keg 30. Connecting point 48 connects a conventional gas pressure regulator 66 to keg coupler 46. Gas pressure regulator 66 is of a well known design, having a pressure control valve, hoses, a hose connecting keg coupler 46 to gas pressure regulator 66, and pressure gauges. The design and functionality of such regulators are well-known to those in the art and will not be discussed in any further detail. A hose connecting point 48 and gas pressure regulator 66 allows pressurized carbon dioxide gas to enter keg 30 to provide a source of carbon dioxide to keep the beer carbonated and to provide pressure so that beer may be dispensed from keg 30.

First liquid conducting hose 40, which has a first end 42 and a second end 44 is connected to coupler 46 at first end 42 and provides a pathway for beer flowing out of keg 30. While various lengths and sizes of hose may be used for first liquid conducting hose 40, in the preferred embodiment of the invention, the inventors have determined that a ⅜-inch I.D. line of about six inches in length is suitable for use in a cooling, carbonation and dispensing system according to the preferred embodiment of the present invention.

As illustrated, keg 30 may be placed on a trolley 20, which includes top 22 and bottom 24, to enable the keg 30 to be easily moved about from one location to another. A plurality of casters 26 is mounted on bottom 24 to facilitate movement of keg 30. A pressure sensitive thermocouple 16 is placed on trolley 20, with a sensing line attached to thermometer 28 mounted on trolley 20, so that a user of the system can have an instant temperature readout, indicating conditions of the beer in keg 30.

A cooling, carbonation and dispensing system 10 according to the preferred embodiment of the present invention includes a cooling ring 50 mounted on top 32 of keg 30 to provide contact cooling of the beer in the keg. Cooling ring 50 is best illustrated in detail in FIGS. 3-6. Cooling ring 50 includes a shell 52, which is generally shaped like a toroid. Shell 52 has an interior 54 and an outer surface 56. A central space 58 is formed by shell 52. First liquid conducting hose 40 is directed through central space 58 to connect to other components of system 10, as will be discussed shortly. Shell 52 may be constructed of a variety of materials. The inventors have found that aluminum, because of its heat transfer characteristics, is suitable for use with shell 52 of cooling and carbonation system 10.

Shell 52 includes a sealable opening 60 connected to a sleeve 62, which, when the system is in use, provides an access for filling interior 54 with dry ice 88, which provides not only contact cooling of beer in keg 30, but is also a source of pressurized carbon dioxide gas for both carbonating and providing pressure for dispensing the beer. A regulator connecting point 68 allows connection of gas pressure regulator 66 to shell 52. Once dry ice 88 is placed in interior 54 to provide cooling, carbonation, and pressurization, sealable opening 60 may be sealed by securing cap 64 over sleeve 62. The inventors have found that a threaded connection between sleeve 62 and cap 64 provides a good means of sealing sealable opening 60.

Cooling ring 50 of system 10 includes a pair of support rings, upper support ring 70 having outer diameter 72 and inner diameter 74 (FIG. 1), and lower support ring 76 having outer diameter 78 and inner diameter 80 mounted on shell 52. A support plate 75 is attached to upper support ring 70 to provide support for the chilling unit 90. Lower support ring 76 is sized so that its outer diameter 78 provides a close fit with lip 38 of keg 30 to firmly secure cooling ring 50 to keg 30. Support rings 70 and 76 may be constructed of a variety of structural shapes and materials. In the preferred embodiment of the invention, support rings 70 and 76 may be constructed of rolled aluminum angle, rolled aluminum channel, stamped aluminum, or rolled aluminum I-beams.

Cooling ring 50 also includes a stand 82 on which cooling ring 50 may be placed when cooling ring 50 is being stored or transported. Stand 82 includes a base 84 connected to upper support ring 70 and lower support ring 76 by means of connecting members 86. Base 84 and connecting members 86 may be constructed of a variety of materials. For example aluminum bars or angles are suitable for this application. Stand 82 not only provides a means for convenient placement of cooling ring 50, but also encloses and protects gas pressure regulator 66 from damage.

A plurality of heat sink fins 87 extend from cooling ring 50 and contact top 32 of keg 30 to provide additional contact cooling of keg 30.

Figure 7:
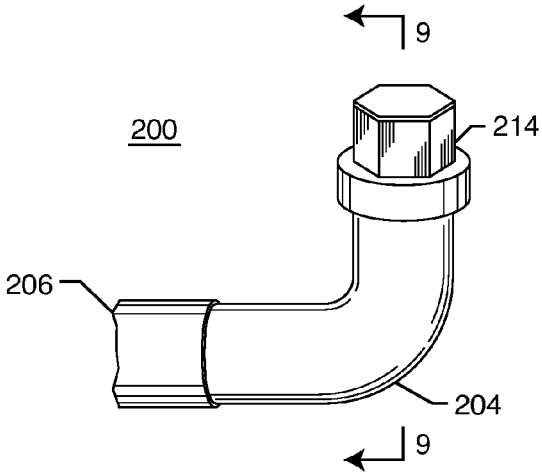
FIG. 7 illustrates a side view of a gas pressure relief valve for use with a preferred embodiment of a cooling, carbonation and dispensing system according to the present invention.
Figure 8:
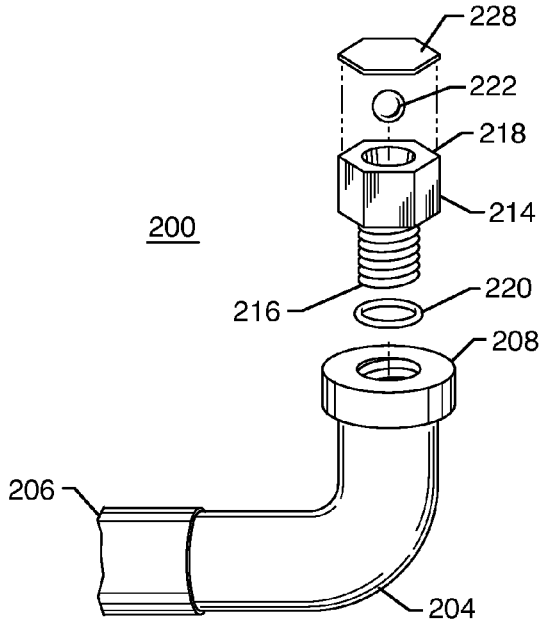
FIG. 8 illustrates an exploded view of a gas pressure relief valve for use with a preferred embodiment of a cooling, carbonation and dispensing system according to the present invention.
Figure 9:
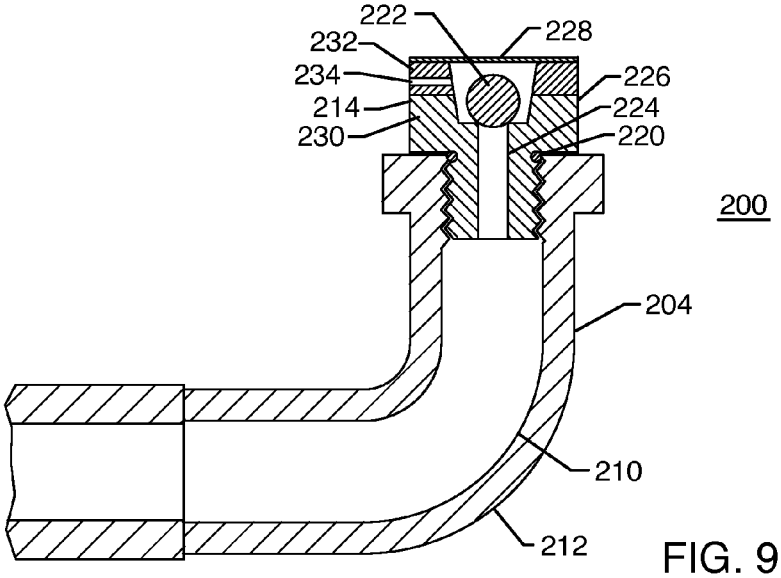
FIG. 9 illustrates a sectional view taken at line 9-9 in FIG. 7.
Figure 13:
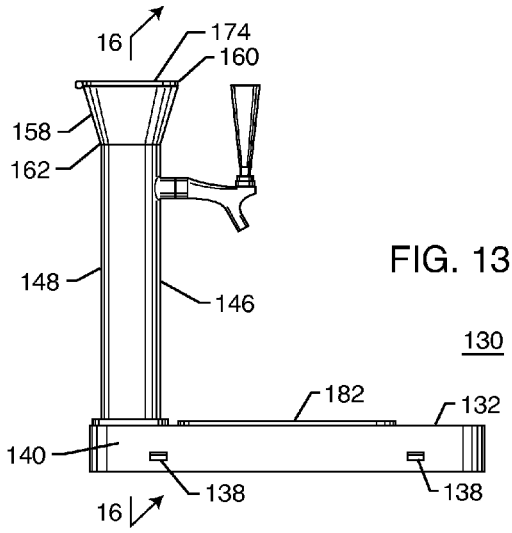
FIG. 13 illustrates a side view of the lid and tower of a preferred embodiment of a cooling, carbonation and dispensing system according to the present invention.
Figure 14:
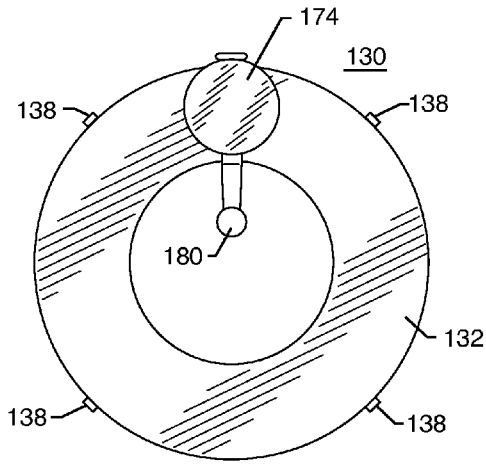
FIG. 14 illustrates a top view of the lid and tower of a preferred embodiment of a cooling, carbonation and dispensing system according to the present invention.
Figure 15:
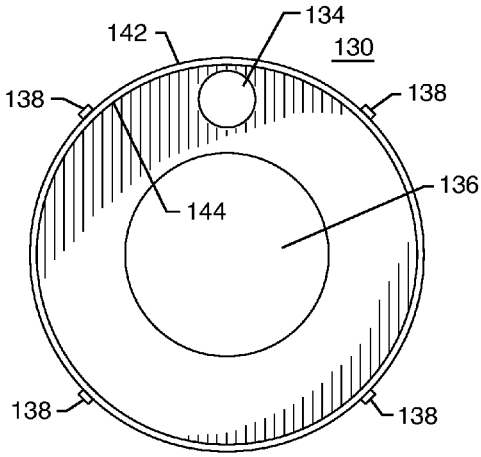
FIG. 15 illustrates a bottom view of the lid and tower of a preferred embodiment of a cooling, carbonation and dispensing system according to the present invention.
Figure 16:
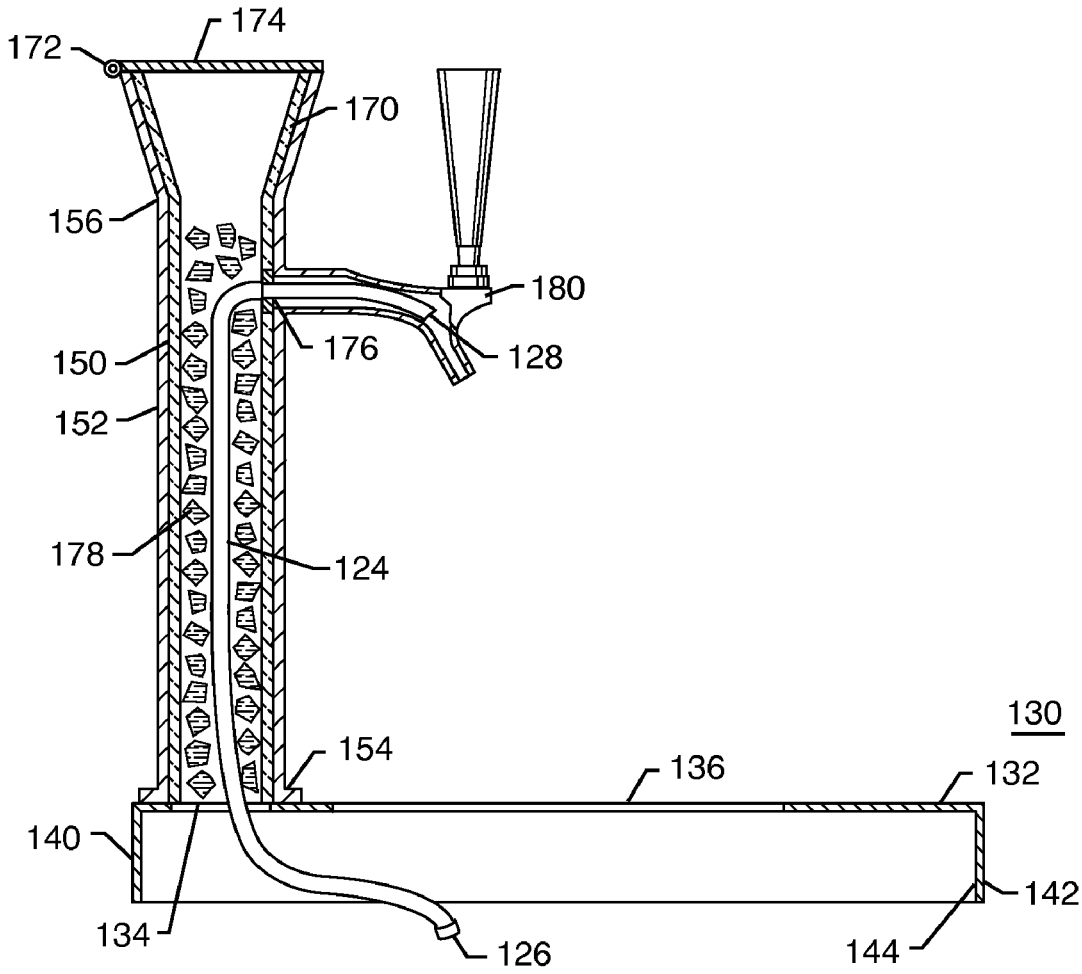
FIG. 16 illustrates a sectional view taken at line 16-16 in FIG. 13.

Cooling ring 50 includes a gas pressure relief valve 200, the construction of which is illustrated in FIGS. 7-9. Valve 200 includes body section 204 having a first end 206 and a second end 208. Valve 200 is connected at first end 206 of body section 204 to shell 52 at connecting point 202, and also includes and inner surface 210 and an outer surface 212.

Valve 200 also includes control section 214, having a first end 216 and a second end 218. First end 216 of control section 214 connects to second end 208 of body section 204. As an option, valve 200 may include an o-ring 220 or equivalent structure where first end 216 of control section 214 attaches to second end 208 of body section 204.

Control section 214 includes an inner surface 224, outer surface 226, and cover 228. Inner surface 224 also includes a magnetic portion 230 and a non-magnetic portion 232. A relief port 234 provides an outlet for carbon dioxide gas when the gas pressure exceeds system parameters. Magnetic ball 222 located inside control section 214 is used to relieve the gas pressure. Because of its magnetic properties, ball 222 will tend to be influenced by magnetic portion 230 of inner valve surface 224 and block the flow of carbon dioxide gas. However, should the carbon dioxide gas pressure exceed system parameters, ball 222 will be moved by the gas pressure so that so that carbon dioxide gas is vented through relief port 234. When the gas pressure is lessened, magnetic ball 222 will move back into place and carbon dioxide will not be relieved through relief port 234.

Located on top of cooling ring 50 is chilling unit 90, which provides what is known as "flash chilling" to the beer as it passes through chilling unit 90. Chilling unit 90 is best illustrated in FIGS. 10-12 and includes outer cylinder 92 having inner surface 94 and outer surface 96, and an inner cylinder 114 that is joined to outer cylinder 92 by means of bottom plate 112. Outer cylinder 92 is configured to form a secure fit with upper support ring 70 and is supported by support plate 75. Inner cylinder 114 forms an opening 116 so that when cooling ring 50 and chilling unit 90 are mounted on top of keg 30, the user of system 10 may still have access to top 32 of the keg and first liquid conducting hose 40.

Outer surface 94 includes a plurality of handles 100 for facilitating movement and placement of chilling unit 90 and also includes a plurality of latches 98 for attaching chilling unit 90 to lid 130, as will be discussed in more detail shortly.

Located between outer cylinder 92 and inner cylinder 114 in chilling unit 90 is hose bundle 104, which includes first end 106 and second end 108. First end 106 attaches to second end 44 of first liquid conducting hose 40 by means of a tube 110 extending through an opening (not shown) in inner cylinder 114. In the preferred embodiment of the invention, hose bundle 104 is a coil of ⅜-inch I.D. barrier tubing approximately 75 feet in overall length. When operating system 10, wet ice 118 is placed inside chilling unit 90, so that beer passing through hose bundle 104 may be rapidly cooled (known in the trade as "flash chilling"). Chilling unit 90 also includes spigot 102, which may be used to drain off water produced from the melting of wet ice 118.

A second liquid conducting hose 164 having a first end 166 and a second end 168 (FIG. 1) is connected at its first end 166 to second end 108 of hose bundle 104 by means of a quick disconnect coupler (not shown) to conduct the beer out of chilling unit 90. The inventors have found that a 3/16-inch I.D. restriction line is suitable for a second liquid conducting hose 164 for use with the present invention. The inventors have found that it in order for the system according to the present invention to function most effectively, second liquid conducting hose 164 should be of a lesser diameter than hose bundle 104 to compensate for the initial liquid temperature in the keg and ambient temperature variations in ambient temperature. Second liquid conducting hose 164 will be of varying length to enable the user to balance the system pressures to optimize the flow of the beer through system 10.

FIGS. 10 and 12-16 illustrate another main component of system 10, which is lid 130. Lid 130 includes a top 132 having first opening 134, second opening 136, and flange 140, and is mounted on top of chilling unit 90. Flange 140 includes outer surface 142 and inner surface 144. Flange 140 is sized so that inner surface 144 fits tightly over outer surface 96 of outer cylinder 92 of the chilling unit. Locking extensions 138 on outer surface 142 are used in conjunction with latches 98 on chilling unit 90 to attach lid 130 to chilling unit 90 and form a watertight seal between them and prevent water from melting wet ice in the chilling unit 90 from leaking.

Lid 130 includes a hollow tower 146 extending from top 132. Tower 146 includes a generally cylindrically-shaped chute 148 having an inner surface 150, outer surface 152, first end 154 and second end 156. First end 154 is attached to top 132 at opening 134. Tower 146 also includes funnel 158 having an upper end 160 and a lower end 162, with lower end 162 attached to second end 156 of chute 148. At upper end 160 is located a hinge 172 and cap 174. Chute 148 includes opening 176 through which beer is dispensed, as will be discussed.

Second liquid conducting hose 164 (see FIG. 1) is routed through system 10 from chilling unit 90 to dispensing hose 124, which is routed through tower 146. Second end 168 of second liquid conducting hose 164 is connected by means of quick disconnect coupler (not shown) to first end 126 of dispensing hose 124, as also illustrated in FIG. 1. Dispensing hose 124 is routed through the opening 176 in chute 148 and its second end 128 is attached to dispenser 180, from which the beer is dispensed. The inventors have found that dispensing hose 124 should be a 3/16-inch I.D. line of about eighteen inches in length to optimize the system, although those skilled in the art will recognize that other sizes and lengths of line may be used for dispensing hose 124. Spill tray 182, mounted in second opening 136 of top 132, catches any beer overflow from dispensing of the beer.

To further provide cooling of the beer, inner surface 150 of chute 148 may be covered by insulation 170. Keg 30, cooling ring 50, chilling unit 90, and lid 130 may also be wrapped in an insulating jacket 184 of thin material to trap air and enhance the cooling and chilling provided by system 10.

Operation of system 10 will now be summarized. Keg 30 is placed in its desired location. Cap 64 on sleeve 62 is removed, so that dry ice 88 may be placed in interior 54 of shell 52. Cap 64 is then placed over sleeve 62, thus sealing shell 52. Cooling ring 50, including shell 52, is mounted on top of keg 30, and first liquid conducting hose 40 is routed through central space 58. Keg coupler 46 is attached to keg 30. Gas pressure regulator 66 is attached to keg coupler 46 by means of a gas line provided with gas pressure regulator 66. First liquid conducting hose 40 is connected to keg coupler 46 at first end 42.

Gas pressure regulator 66 is attached to shell 52 at connecting point 68. Chilling unit 90 is placed on top of cooling ring 50, and second end 44 of first liquid conducting hose 40 is connected to first end 106 of hose bundle 104. Second liquid conducting hose 164 (see FIG. 1) is connected to second end 108 of hose bundle 104. At this point, ice may be placed in chilling unit 90 around hose bundle 104.

Lid 130 is placed on top of chilling unit 90, and second liquid conducting hose 164 (FIG. 1) is connected to dispensing hose 124. Latches 98 on chilling unit 90 are used in conjunction with locking extensions 138 on lid 130 to provide a seal between lid 130 and chilling unit 90. Dispensing hose 124 is connected to dispenser 180. Pressure regulator 66 is then operated to introduce carbon dioxide gas into keg 30 to maintain the carbonation of the beer and provide pressure to dispense the beer. Beer is cooled by contact between keg 30 and cooling ring 50 and by flash chilling in chilling unit 90. When wet ice in chilling unit 90 begins to melt, spigot 102 may be used to drain off water, and cap 174 on tower 146 may be opened and wet ice 178 may be placed in the tower to maintain the supply of ice in chilling unit 90 and provide further cooling of the beer in tower 146. Insulating jacket 184 traps cold air and enhances the cooling provided by system 10.

The foregoing description of an exemplary embodiment of the present invention has been presented for purposes of enablement, illustration, and description. It is not intended to be exhaustive of or to limit the present invention to the precise forms discussed. There may be, however, other configurations of cooling, carbonation and dispensing systems not specifically described herein, but with which the present invention is applicable. The present invention should therefore not be seen as limited to the particular embodiment described herein; rather, it should be understood that the present invention has wide applicability with respect to cooling, carbonation and dispensing systems. Such other configurations can be achieved by those skilled in the art in view of the description herein. Accordingly, the scope of the invention is defined by the following claims.

What is claimed is:

1. A method for cooling and carbonating liquid in a keg, said keg having a top, a bottom, an outer surface, a lip around the top, and a first liquid conducting hose extending from the keg, the method comprising the steps of:

providing an enclosed cooling ring having a central space and a sealable opening, said cooling ring shaped generally like a toroid;

inserting dry ice inside the cooling ring through the sealable opening;

connecting a gas pressure regulator between said cooling ring and said keg;

placing the cooling ring on top of and in contact with the keg;

directing the first liquid conducting hose through the central space of the cooling ring;

sealing the sealable opening in the cooling ring; and passing liquid through said first liquid conducting hose.

2. The method according to claim 1, further comprising:

mounting a chilling unit having a hose bundle on the cooling ring;

connecting said first liquid conducting hose to said hose bundle;

filling the chilling unit with wet ice and water; and passing the liquid through the hose bundle.

3. The method according to claim 2, further comprising the steps of:

connecting a second liquid conducting hose to said hose bundle;

mounting a lid having a hollow tower on said chilling unit, said lid forming a water tight seal with said chilling unit, said tower having an opening and extending from said lid;

connecting a dispensing hose to said second liquid conducting hose;

extending said dispensing hose through said hollow tower and through said opening;

connecting a dispenser to said dispensing hose; and passing liquid from the keg through said first liquid conducting hose, said hose bundle, said second liquid conducting hose, and said dispensing hose to said dispenser.

4. The method according to claim 3, further comprising the step of:

inserting wet ice into said tower.

5. The method according to claim 3, further comprising the step of:

providing an insulating jacket enclosing said keg, said cooling ring, said chilling unit, and said lid.

6. The method according to claim 3, wherein the inner diameter of said second liquid conducting hose is less than the inner diameter of said hose bundle, to compensate for initial liquid temperature in the keg and ambient temperature variants.

* * * * *